US006023940A

United States Patent [19]

Abbott et al.

[11] Patent Number: 6,023,940

[45] Date of Patent: Feb. 15, 2000

[54] FLOW DISTRIBUTOR FOR AIR CONDITIONING UNIT

[75] Inventors: Alan D. Abbott, Manlius, N.Y.; Keon-Woo Lee, Seoul, Rep. of Korea; Christopher G. Repice, Syracuse, N.Y.; S. Rudy Chou, Liverpool, N.Y.; Mark A. Daniels, Manlius, N.Y.

[73] Assignee: Carrier Corporation, Farmington, Conn.

[21] Appl. No.: 09/110,567

[22] Filed: Jul. 6, 1998

[51] Int. Cl.[7] ..... F25B 39/02

[52] U.S. Cl. ..... 62/504; 62/525; 62/511; 62/474; 62/317; 55/510; 210/445; 210/482; 210/499

[58] Field of Search ..... 62/525, 504, 511, 62/474, 317; 55/510; 210/445, 482, 499

[56] References Cited

U.S. PATENT DOCUMENTS 3,795,259 3/1974 Brandin et al. ..... 137/561
3,864,938 2/1975 Hayes , Jr. ..... 62/504
4,543,802 10/1985 Ingelmann et al. ..... 62/525
5,341,656 8/1994 Rust, Jr. et al. .
5,492,143 2/1996 Cooper et al. ..... 137/15
5,894,741 4/1999 Durham et al. ..... 62/525

*Primary Examiner*—Henry Bennett
*Assistant Examiner*—Mark Shulman
*Attorney, Agent, or Firm*—Wall Marjama Bilinski & Burr

[57] ABSTRACT

A split air conditioner unit having a distributor located indoors for delivering refrigerant to a plurality of evaporator flow circuits. The distributor is connected to an outdoor condenser by a refrigerant line containing an expansion device. A strainer is located at the entrance to the distributor that homogenizes the expanded two phase mixture so that refrigerant of equal quality is delivered to each of the evaporator flow circuits.

7 Claims, 3 Drawing Sheets

FLOW DISTRIBUTOR FOR AIR CONDITIONING UNIT

BACKGROUND OF THE INVENTION

This invention relates to air conditioning and, in particular, to a flow distributor for providing equal quality refrigerant to each circuit of a multi-circuit evaporator.

The term quality, as herein used, refers to a two phase mixture of expanded refrigerant having a vapor phase and a liquid phase. The quality of the mixture is the per cent by weight of the mixture that is in the vapor phase.

High precision distributors are sometimes used in association with evaporator heat exchangers having multiple flow circuits. The distributors are typically equipped with sharp edge orifices permanently affixed inside the distributor. These devices are relatively complex in design and relatively expensive to manufacture and install. Despite the use of precision machined parts, the flow distribution can, on occasion, be relatively uneven and these devices also tend to be relatively noisy and thus objectionable when used indoors.

In many split refrigeration systems where the evaporator is located indoors, the condenser and the expansion device for throttling refrigerant moving between the condenser and the evaporator are both located out of doors along with the system compressor. The refrigerant line connecting the condenser and the evaporator is thus relatively long and, as a result, the two phase mixture leaving the outdoor expansion device can undergo separation. When splitting the flow into the evaporator circuits, the separated flow can cause uneven quality levels in the evaporator wherein some circuits receive a higher or lower percentages of the gas phase resulting in less than optimum evaporator performance.

In U.S. Pat. No. 5,341,656 there is described an expansion device for use in a heat pump wherein expanded refrigerant is delivered directly into a distributor. The expanded flow leaving the device is initially turned 90° into a radially disposed channel and then empties through a series of sharp edge orifices into the evaporator flow circuits. The flow circuits are located very close to the expansion device so that the two phase mixture leaving the device is not afforded the opportunity to separate before it is delivered into the evaporator flow circuits. Accordingly, the quality of the refrigerant passing through the circuits is relatively constant. However, as noted above, in split refrigeration systems where the expansion device is located out of doors, the two phase expanded refrigerant must travel a good distance through the refrigeration line before reaching the distributor. As a result, the liquid phase can separate from the vapor phase thus adversely effecting the operation of the downstream evaporator.

SUMMARY OF THE INVENTION

It is a primary object of this invention to improve air conditioning systems.

It is a further object of this invention to improve split air conditioning systems wherein the evaporator is located indoors and the condenser is located out of doors.

A still further object of the present invention is to improve split air conditioning systems utilizing evaporators having a plurality of refrigerant flow circuits.

Another object of the present invention is to provide a refrigerant flow distributor for use in association with a multiple circuit evaporator for delivering expanded refrigerant of equal quality to each of the evaporator circuits.

Yet another object of the present invention is to reduce the amount of indoor noise generated by a split air conditioning system.

Still another object of the present invention is to provide a relatively simple and inexpensive means for homogenizing a two phase mixture of refrigerant as the two phase mixture passes through the distributor of an air conditioning system.

These and other objects of the present invention are attained in an air conditioning unit having a condenser that is connected by a refrigerant line to an evaporator containing multiple flow circuits. The refrigerant line contains an expansion device for throttling refrigerant moving through the line from the condenser to the evaporator into a two phase mixture. A flow distributor is mounted adjacent to the evaporator that includes a plurality of feeder lines for delivering expanded refrigerant to the flow circuits of the evaporator. A screen is mounted at the entrance to the distributor for acting upon the two phase mixture so that a homogenous mixture is passed through the distributor into each of the evaporator flow channels. The invention is well suited for use in a split system where the evaporator is located indoors with the distributor while the condenser, the expansion device and the compressor are located outdoors thereby considerably reducing the amount of indoor noise that is generated by the unit.

BRIEF DESCRIPTION OF THE DRAWINGS

For a better understanding of these and other objects of the present invention, reference will be made to the following detailed description of the invention which is to be read in association with the accompanying drawings, wherein.

DETAILED DESCRIPTION OF THE INVENTION

Figure 1:
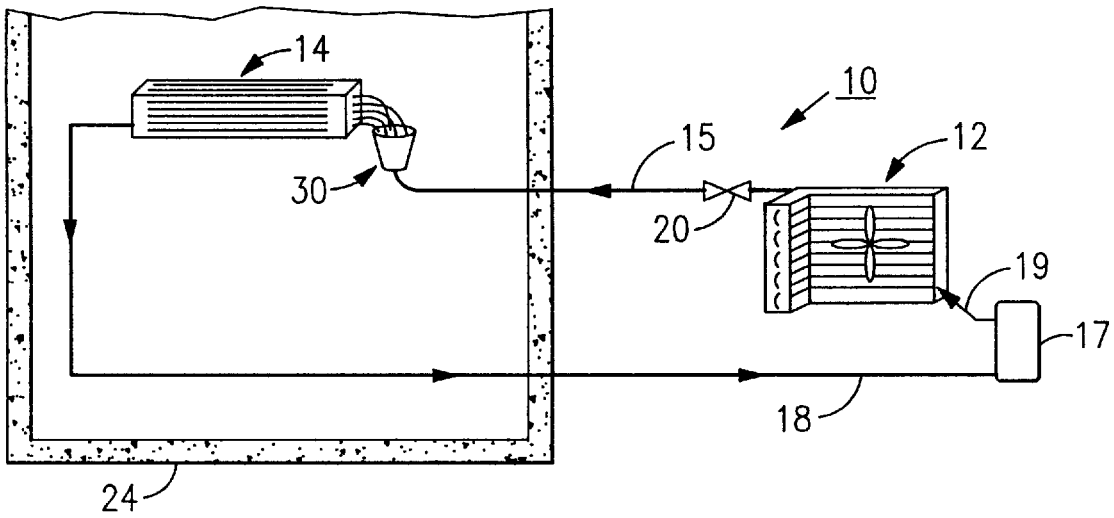
FIG. 1 is a schematic representation of an air conditioning system embodying the teachings of the present invention.

Referring initially to FIG. 1, there is illustrated an air conditioning unit, generally referenced 10, that includes a condenser heat exchanger (condenser) 12 that is connected to an evaporator heat exchanger (evaporator) 14 by means of a refrigerant line 15. The evaporator is connected to the suction side of a refrigerant compressor 17 by means of a suction line 18. The condenser, in turn, is connected to the discharge side of the compressor by means of a supply line 19. An expansion device 20 is mounted in the refrigerant line that serves to throttle high pressure, high temperature refrigerant leaving the condenser to a lower pressure and temperature. As a result of the expansion process, a two phase refrigerant mixture is produced downstream from the expansion device that includes a liquid phase and a vapor phase.

The refrigeration unit 10 is a split system in which the evaporator is located inside a structure 24 to provide cooling. The condenser, the compressor and the expansion device are all located outside of the structure to reduce indoor noise and unwanted indoor heating. As a result, the two phase mixture produced by the expansion device is forced to travel along a relatively long length of refrigerant line prior to entering the evaporator. Due to the extended length of the refrigerant line between the expansion device and the evaporator, the liquid phase can become separated from the vapor phase. A separated flow can result in less than optimum evaporator performance. In the case of a split system where the two phase mixture must be distributed into multiple evaporator flow circuits, a separated flow can also cause uneven quality levels in each of the circuits thus further adversely effecting evaporator performance.

Figure 2:
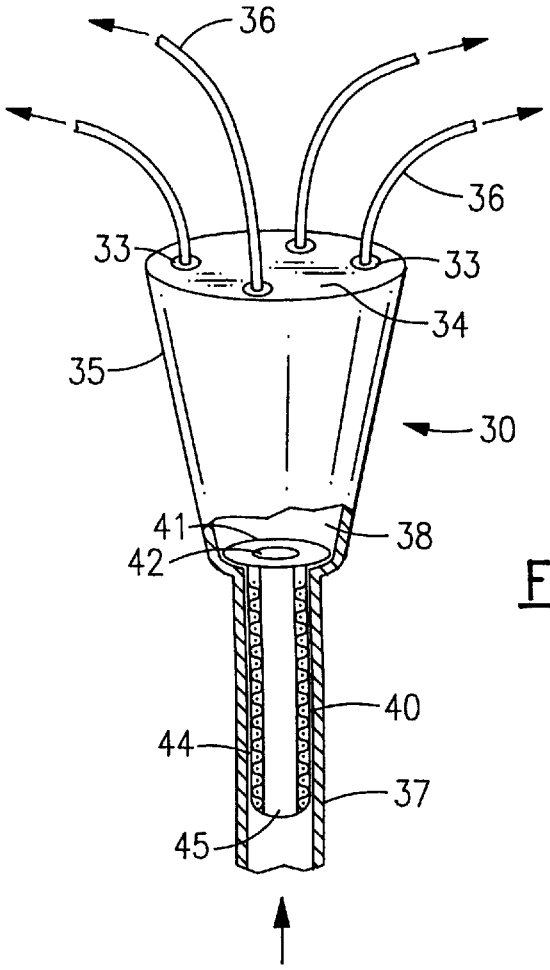
FIG. 2 is an enlarged partial side view of a distributor employed in the above-noted air conditioning system.

The present system includes a distributor, generally referenced 30, that is equipped to homogenize the two phase flow prior to the flow entering the evaporator. In this preferred embodiment of the invention, the evaporator contains a plurality (four) of separate flow circuits. The distributor, as best shown in FIG. 2, includes a housing 35 that has four outlet feeder lines 36 that are coupled to outlet ports 33 found in the top wall 34 of the distributor housing. The feeder lines are arranged to deliver refrigerant to the evaporator flow circuits. A cylindrical connector tube 37 is mounted at the inlet 38 to the distributor which serves to couple the distributor to the refrigerant line 15. Although the connector tube is shown as a part separate from the refrigerant line, it can be made integral with the line without departing from the teachings of the present invention.

A cylindrical strainer 40 having a flange 41 at its open upper end 42 is mounted inside the connector tube with the strainer flange being either brazed or seam welded to the inlet port of the distributor housing to form a fluid tight joint between the strainer and the distributor. Alternatively, the strainer may be press fitted into the inlet port or flare fitted for the same purpose.

When assembled within the connector tube a gap or space 44 is provided between the outer surface of the strainer and the inside surface of the connector tube so that the entire surface area of the strainer is exposed to the two phase flow moving toward the evaporator. The bottom wall 45 and the circular side wall of the strainer are formed of a wire mesh that provides for about 30% open flow area over the surface of the strainer. The length of the strainer is preferably between six (6) and seven (7) times its outside diameter. The strainer is fabricated from stainless steel or any similar material that will not be adversely effected by the refrigerant.

The two phase flow moving through the strainer becomes thoroughly mixed so that the quality of the refrigerant that is passed on to the evaporator flow circuits is substantially equal. As a result, the evaporator performance is optimized, the capacity of the evaporator is increased and the superheat generated in each of the circuits is substantially uniform.

Although an elongated cylindrical strainer is utilized in the preferred embodiment of the present invention, it should be clear to one skilled in the art that strainers having varying shapes may be used in the practice of the present invention. Accordingly, the strainer may be a flat disc or a cup shaped member mounted at the entrance of the distributor housing provided the strainer does not impede the flow through the housing or create an excessive pressure drop over the distributor that might adversely effect the performance of the system.

Figure 3:
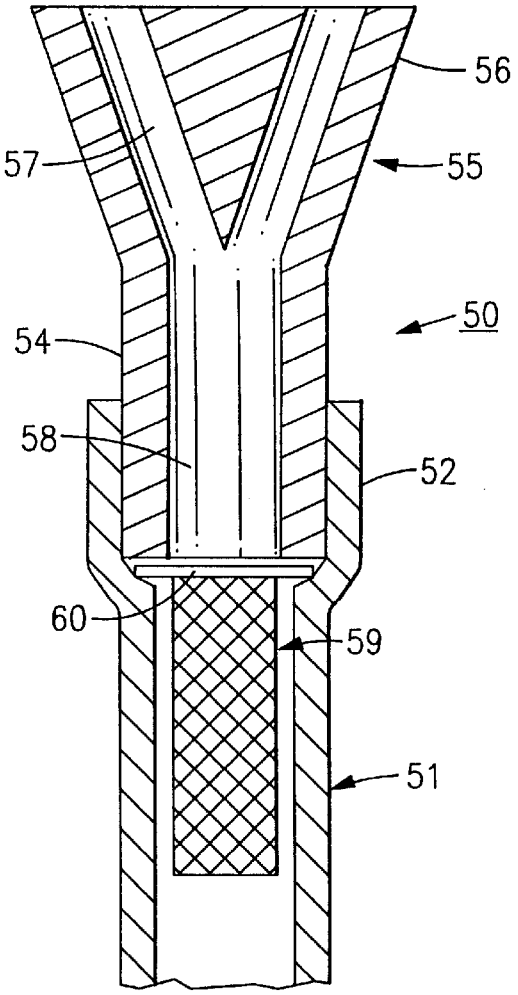
FIG. 3 shows a further embodiment of the invention wherein the connector piece is integral with the refrigerant line.

Referring now to FIG. 3, there is shown an embodiment of the invention generally referenced 50 wherein the connector 51 contains an expanded opening 52 at its upper end that is adapted to receive therein a cylindrical lower inlet section 54 of the distributor 55. The upper outlet section 56 of the distributor is conical shaped and contains a number of outlet ports 57 that are fed from a single inlet port 58. A strainer 59 having an upper flange 60 is inserted into the top of the connector 51 with the flange being seated in the bottom of the expanded opening in the connector. The flange in assembly is captured between the distributor and the connector and the joint between the three elements closed by any suitable means used in the industry such as soldering or the like. Here again, two phase refrigerant moving into the distributor is forced to move through the strainer, thus becoming thoroughly mixed prior to being delivered into the evaporator circuits.

Figure 5:
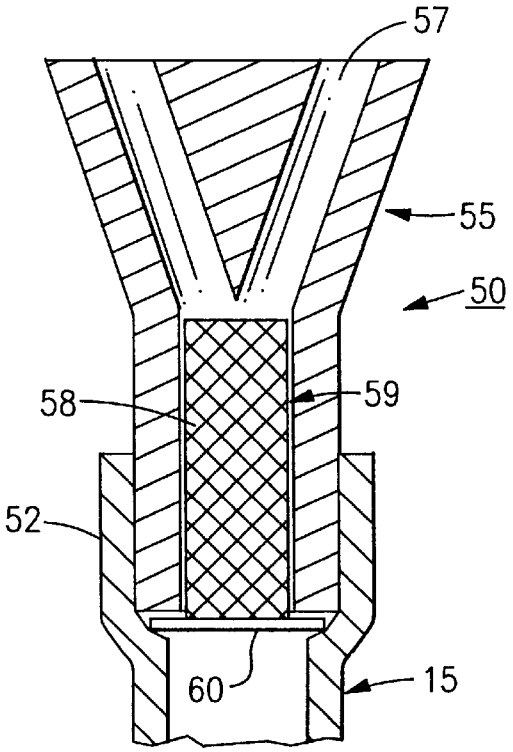
FIG. 5 shows another embodiment of the invention wherein the strainer is contained within the distributor.
Figure 4:
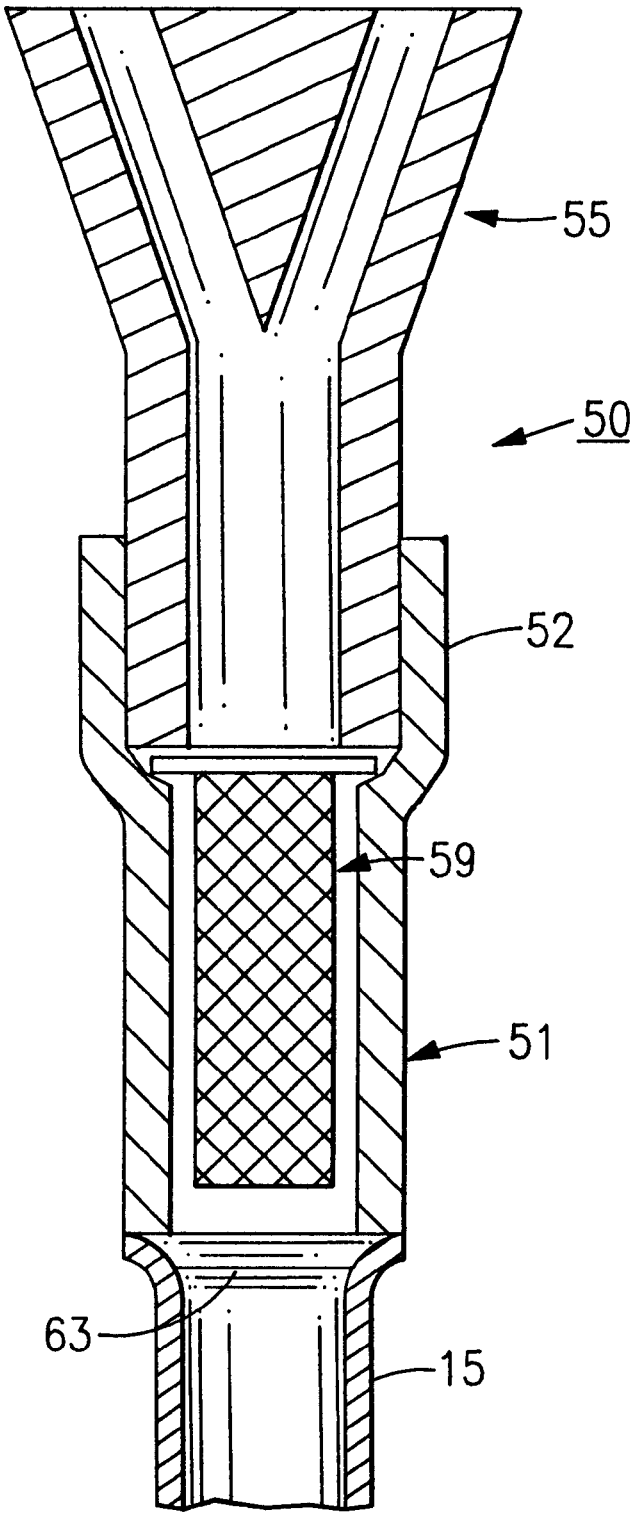
FIG. 4 shows a still further embodiment of the invention wherein the connector piece is joint with the refrigerant line.

A further embodiment of the invention is shown in FIG. 4 where like reference numerals are used to designate like components as those illustrated in FIG. 5. Here again the distributor 55 is inserted into the expanded opening 52 of the connector 51 and the strainer 59 is mounted within the connector as explained above in reference to FIG. 3. The refrigerant line 15 is, in turn, joined to the bottom of the connector and is secured thereto to provide a leak tight joint at 63. As can be seen in this embodiment, the space between the outer surface of the strainer and the inner surface can be radically expanded thus providing for greater design flexibility.

FIG. 5 represents a still further embodiment of the invention wherein like numerals are again used to identify the same components as those described with reference to FIG. 3. In this embodiment of the invention, the strainer 59 is inverted so that the body of the strainer is contained within the inlet port 58 of the distributor 55. Here again the flange 60 of the strainer is captured between the distributor and the bottom of the expanded upper opening in the connector and the joint between the elements closed and sealed against leakage. The body of the strainer is placed closer to the entrance to the distributor outlet ports, thus further insuring that the two phase mixture delivered to the evaporator circuits is thoroughly mixed.

While this invention has been explained with reference to the structure disclosed herein, it is not confined to the details set forth and this invention is intended to cover any modifications and changes as may come within the scope of the following claims:

What is claimed is:

1. In an air conditioning unit containing a condenser that is connected to an evaporator means by a refrigeration line, said unit further including a distributor means having an inlet port and a series of outlet ports each of which is connected to a flow circuit in the unit evaporator, an expansion means in the refrigerant line for throttling refrigerant moving in said line into a two phase mixture that includes a liquid phase and a vapor phase, connecting means for coupling the inlet port of the distributor means with the refrigerant line, a strainer means mounted in said connecting means through which throttled refrigerant passes for homogenizing the mixture as it passes into the distributor means, said strainer means is a cylindrical member wherein the length of said strainer is about between six and seven times greater than its diameter, and said strainer has a mesh size that provides the strainer with about between a 25% and 35% open area, and said connecting means is a tubular member, the inside diameter of the tubular member being greater than the outside diameter of the cylindrical member so that a space is provided between the two members.

2. Distributor apparatus for use in an air conditioning system having a condenser connected to an evaporator by a refrigerant line, said apparatus including a distributor mounted adjacent to the evaporator having an entrance connected to the refrigerant line and a series of outlets each being connected to a flow circuit in said evaporator;

an expansion means mounted in said refrigerant line for throttling refrigerant leaving said condenser to a lower temperature and pressure so that the refrigerant forms a two phase mixture in the line;

said expansion means being located a distance from the entrance to the distributor means along the refrigerant line such that the mixture moving through the line can separate into two independent phases prior to entering the distributor; and a strainer means mounted at the entrance to the distributor through which the refrigerant passes, said strainer means having openings therein for recombining the separated phases into a two-phase mixture so that the quality of refrigerant delivered to each of the evaporator flow circuits is about equal.

3. The apparatus of claim 2 wherein said strainer is a cylindrical number mounted at the entrance to the distributor.

4. The apparatus of claim 3 wherein the length of the strainer is about six to seven times greater than its diameter.

5. The apparatus of claim 2 wherein the openings in the strainer has a 25% to 35% open area.

6. The apparatus of claim 3 wherein said cylindrical strainer is mounted inside the refrigeration line.

7. The apparatus of claim 2 that further includes elongated tubular connectors for coupling the refrigeration line with the entrance to the distributor and said strainer means includes a cylindrical member mounted inside said connector in axial alignment therewith, the outside diameter of the cylindrical member being less than the inside diameter of the tubular connector.

* * * * *